United States Patent [19]

Yamazaki

[11] 4,137,629

[45] Feb. 6, 1979

[54] ELECTRIC SHAVER

[75] Inventor: Tadashi Yamazaki, Matsumoto, Japan

[73] Assignee: Izumi Seimitsu-Kogyo Kabushiki Gaisha, Nagano, Japan

[21] Appl. No.: 721,485

[22] Filed: Sep. 8, 1976

[30] Foreign Application Priority Data

May 26, 1976 [JP] Japan ..... 51-67215[U]

[51] Int. Cl.[2] ..... B26B 19/16

[52] U.S. Cl. ..... 30/43.5

[58] Field of Search ..... 30/43.4, 43.5, 43.6

[56] References Cited

U.S. PATENT DOCUMENTS

| | | | |
|---|---|---|---|
| 3,890,709 | 6/1975 | Tietjens | 30/43.6 |
| 3,913,225 | 10/1975 | Tietjens | 30/43.6 |
| 4,001,932 | 1/1977 | Herrick | 30/43.5 |
| 4,038,748 | 8/1977 | Tyler | 30/43.6 |
| 4,077,120 | 3/1978 | Herrick et al. | 30/43.5 |

FOREIGN PATENT DOCUMENTS

| | | | |
|---|---|---|---|
| 2413592 | 10/1974 | Fed. Rep. of Germany | 30/43.5 |

*Primary Examiner*—Gary L. Smith

[57] ABSTRACT

Disclosed is an improvement of electric shaver having a shearing blade assembly held in a suspended way. An electric shaver according to this invention uses a cantilever spring plate which functions to push and raise the outer blade as a counter action to the descent of the outer blade which is caused by a strong push of the shaver against the skin of the face, thus assuring a pleasing touch on the face and the clean shaving.

2 Claims, 2 Drawing Figures

ELECTRIC SHAVER

This invention relates to an electric shaver, and more particularly it relates to an electric shaver having a shearing blade assembly held in a suspended way.

As is well known, the blade assembly of the electric shaver of such suspension type is consisted of a stationary perforated outer blade and a rotating inner blade, which is spring-biased and is resiliently pushed against the outer blade, thus holding a whole blade assembly in a suspended way.

With this arrangement, the blade assembly of the electric shaver when pushed against the skin of a human face, will resiliently retire from the original, stress-free position, still keeping close contact with the skin of the face. This resilient fitting action of the blade assembly affords a pleasing touch on the skin of the face. But, if a user pushes the shaver against his face with a relatively strong force in the hope of clean shaving his face, the blade assembly will not closely fit the skin of the face, thus not clean shaving his face. If use is made of a spring which is enough strong to overcome the counter force to the strong push of the blade assembly, the inner blade would be pushed against the outer blade with such a strong resilient force that the inner blade will be caught by the outer blade and cannot rotate.

The object of this invention is to provide an improved electric shaver of the type mentioned above, assuring a pleasing fit and clean shaving even if the shaver is pushed against the skin of the face with a relatively strong force.

This object is attained by an electric shaver according to this invention which comprises, in a housing, at least one apertured outer blade loosely fitted in an aperture of a head of the housing; an inner blade spring-biased and held rotatably in contact with the outer blade; and a spring plate fixed to the head and extending under the outer blade at such a position that if a force which is strong enough to overcome the resilient force applied by the inner blade to the outer blade, is applied to the outer blade in the opposite direction to the resilient force by the inner blade, and if the outer blade accordingly descends, the lower part of the so-descending outer blade is brought in contact with the spring plate, thus causing the spring plate to push up and raise the outer blade against the strong force.

Other objects and advantages of this invention will be better understood from the following description of a preferred embodiment, which is shown in the drawings.

Figure 1:
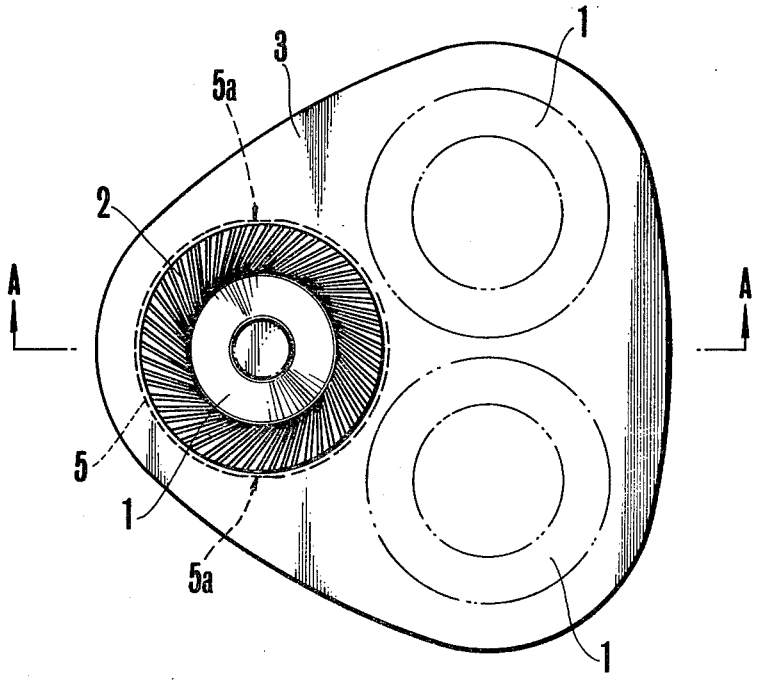
FIG. 1 shows diagrammatically a head of an electric shaver according to the invention.

Referring to the drawings, 1 is an outer blade having a plurality of slots 2 made generally in a convolute direction. The outer blade 1 is fitted loosely in a holding aperture 4 in a suspended way, which is later described in detail. An annular flange 5 is integrally connected to the bottom or lower part of the hollow cylinder of the outer blade, and the circumference 4*a* of the holding aperture 4 catches the flange 5 of the outer blade, thus preventing the outer blade 1 from slipping off from the holding aperture of the head 3. As indicated at 5*a* in FIG. 1, the annular flange has two opposite straightened portions, and these portions meet the counter straightened portions of the circumference of the holding aperture, thus preventing the outer blade from rotating in the aperture of the head.

Figure 2:
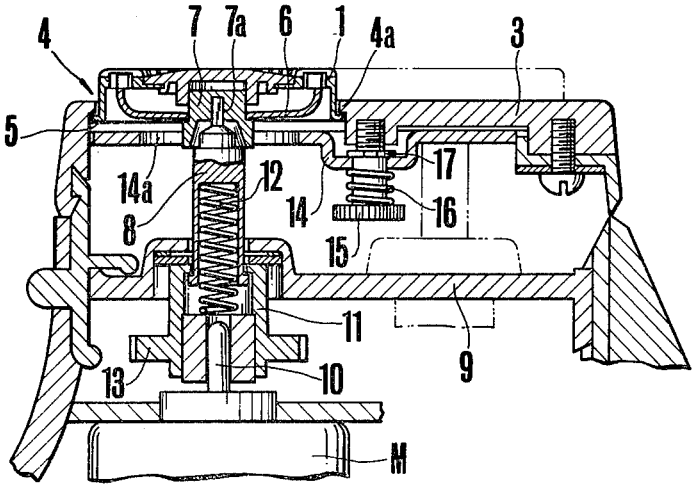
FIG. 2 is a sectional view of the head taken along the line A—A and as viewed in the direction indicated by arrow.

6 is an inner blade which is convex in shape. The inner blade 6 is fixed to a holder 7, and the holder is detachably connected to a universal joint 8 by inserting the square top of the joint in the square aperture 7*a* of the holder 7. As best shown in FIG. 2, the universal joint is in the form of a hollow cylinder, which is open at the bottom. The universal joint is loosely fitted in the aperture of a bottom plate 9. The universal joint is spline-fitted in a cylindrical axis 11, which is, in turn, fixed to the shaft 10 of an electric motor "M". A coiled spring 12 is fitted in the hollow space of the universal joint. As is readily understood, the spring 12 applies a resilient force to the inner blade, thus pushing it against the outer blade. 13 is a driving gear integrally connected to the outer circumference of the cylindrical axis, and the driving gear 13 engages two other similar gears which are associated with the other blade assemblies indicated by broken lines in FIG. 1 and the driving gear 13 transmits the driving power to the other inner blades.

As best shown in FIG. 2, an abutment or spring plate 14 in the form of a cantilever is used. The universal joint 8 is loosely inserted in an aperture 14*a* of the cantilever plate. The plate is fixed to the back of the head 3, and the horizontal or stress-free position of the plate is adjusted by an adjusting screw 15. A spring 16 around the adjusting screw will apply a resilient force to urge the cantilever plate to assume the original position, if the outer blades are pushed down until they are in contact with the cantilever plate, still descending and pushing and causing the cantilever plate to detach the stopper ring 17. Otherwise, the spring 16 around the adjusting screw and the stopper ring 17 hold the cantilever plate so as to leave a space between the bottoms of the outer blades and the cantilever plate. This space can be properly adjusted by driving the adjusting screw.

The head 3 is adapted to open and close, thus allowing a user to remove piles of filaments from the bottom plate 9 or to adjust the position of the adjusting screw.

In operation, when the motor "M" is energized, the inner blades 6 are rotated and cooperate with the outer blades 1 so as to cut the fine filaments entering at the slots of the outer blade. When the outer blades 1 of the head of the electric shaver is pushed against the skin of the face, as a counter action the outer blades push down the associated universal joints 8, thus accordingly compressing the coiled springs 12. If the blades 1 are brought into contact with the cantilever plate 14, the blades 1 push down it against the resilient force of the spring 16. Thus, when the outer blades of the head are pushed against the skin of the face with a relatively strong force, the spring 16 applies a counter force to the outer blade, thus keeping them close contact with the skin of the face at all times.

As is apparent from the above, if an electric shaver according to this invention is pushed against the skin of the face, the outer blades which are resiliently supported by the spring 12 in a suspended way, will touch gently and pleasingly on the skin of the face and will shave, and if the shaver is still pushed against the skin of the face until the outer blades are brought into contact with the underlying cantilever plate so as to push down the same, the outer blades apply a counter force to the skin of the face under the resilient influence exerted by the strong spring 16, thus fitting the outer blades of the head still close to the skin of the face while allowing the inner blades to rotate in contact with the outer blades under the resilient influence of the weak spring 12. The spring 16 selectively applies a resilient force to the outer blades rather than the inner blades, and its resilient action to the outer blades assures that the outer blades are held still close contact with the skin of the face if the head is pushed against the skin of the face with a relatively strong force, and thus the smooth and clean shaving is assured.

In the embodiment the cantilever plate is described as having an associated spring, but it should be understood that if the cantilever plate is, in nature, resilient properly for that purpose, the spring need not be used.

What is claimed is:

1. An electric shaver comprising, a housing having a head with an aperture therein, at least one slotted outer blade loosely fitted in said aperture, an inner blade disposed underneath said outer blade, a universal joint connected to said inner blade, spring means biasing said universal joint in a direction to resiliently push said inner blade into contact against the outer blade, an electric motor connected to said universal joint to rotate said inner blade, said outer blade having a depending portion which is at a lower level than said inner blade, and a cantilever plate fixed to said head and extending under said depending portion of said outer blade at a predetermined distance therefrom, said cantilever plate being provided with an adjusting screw and a spring around said screw for adjustably positioning said cantilever plate so as to provide said predetermined distance which is adjustable between said depending portion of said outer blade and the upper surface of the cantilever plate, whereby if a force which is stronger than the resilient force of said spring means is applied to said outer blade to cause same to descend, said depending portion of the outer blade will be brought into contact with said cantilever plate, thus causing said plate by means of the last said spring to apply a resilient force to said outer blade to raise it up.

2. An electric shaver according to claim 1, wherein said head of the housing is adapted to open and close, thus allowing an access to the interior of said head.

* * * * *